US005960635A

United States Patent [19]

Dakhil

[11] Patent Number: 5,960,635

[45] Date of Patent: Oct. 5, 1999

[54] AIR CONDITIONING APPARATUS USING LIQUID NITROGEN

[76] Inventor: Farouk Dakhil, Viale R. Belloni, 56, 00061 Anguillara S. Rome, Italy

[21] Appl. No.: 09/033,759

[22] Filed: Mar. 3, 1998

[51] Int. Cl.[6] ..... F17C 7/04

[52] U.S. Cl. ..... 62/48.1; 62/78

[58] Field of Search ..... 62/48.1, 78

[56] References Cited

U.S. PATENT DOCUMENTS

| | | | |
|---|---|---|---|
| 2,926,501 | 3/1960 | Morrison . | |
| 3,374,640 | 3/1968 | Boese . | |
| 3,385,073 | 5/1968 | Snelling . | |
| 3,433,028 | 3/1969 | Klee . | |
| 3,662,561 | 5/1972 | Schroeder . | |
| 3,802,212 | 4/1974 | Martin et al. . | |
| 4,474,028 | 10/1984 | Miller et al. . | |
| 4,745,760 | 5/1988 | Porter . | |
| 4,771,608 | 9/1988 | Lui et al. | 62/48.1 |
| 5,291,738 | 3/1994 | Waldrop . | |
| 5,315,840 | 5/1994 | Viegas et al. . | |
| 5,421,171 | 6/1995 | Wardle . | |
| 5,457,963 | 10/1995 | Cahill-O'Brien et al. | 62/78 |
| 5,649,427 | 7/1997 | Sawada et al. | 62/48.1 |

*Primary Examiner*—Ronald Capossela
*Attorney, Agent, or Firm*—Merchant & Gould

[57] ABSTRACT

Air conditioning apparatus using liquid nitrogen. A source of liquid nitrogen fills a pressure vessel as necessary. A release valve releases the liquid nitrogen from the pressure vessel into a housing to absorb latent heat and become nitrogen gas. A thermostat controls the release valve. A dehumidifying arrangement blows warmer air from outside the housing to mix with the nitrogen gas inside the housing to become a cooler air mixture. The dehumidifying arrangement further dehumidifies the cooler air mixture before directing the cooler air mixture to the atmosphere outside the housing.

6 Claims, 4 Drawing Sheets

AIR CONDITIONING APPARATUS USING LIQUID NITROGEN

FIELD OF THE INVENTION

The present invention is directed to air conditioners, and more particularly to air conditioning apparatus using liquid nitrogen released into an air space to create cooling.

BACKGROUND OF THE INVENTION

The earth's atmosphere is comprised primarily of nitrogen and oxygen. Nitrogen is predominant in that air composition is 78.084% nitrogen by volume and 20.946% oxygen by volume. Thus, nitrogen is extremely plentiful.

Nitrogen becomes a liquid at −320° F. When nitrogen vaporizes, it has a very high cooling capacity (latent heat). Nitrogen and the cryogenic property of nitrogen have been known for over 200 years. Two types of systems are possible using nitrogen. First, it is known to use a closed-coil, heat-exchanger system. The problem with such systems is that there can be a surging effect as liquid nitrogen gassifies. Unless such systems are carefully designed, this can lead to high pressure and the possibility of explosion. Others have worked at solving the problems with closed systems. Acceptable designs, however, become very complex, and are ultimately expensive. Secondly, liquid nitrogen as disclosed in the present application can be used in an open system by releasing the liquid nitrogen to gassify in the space to be air-conditioned. Until the present invention, liquid nitrogen has not been used in an open system for a room air-conditioner as disclosed in the present invention.

In conventional air conditioning and refrigeration systems, compressors are used. Chlorofluorocarbons, such as freon, are used as refrigerants. Such gases are now known to endanger the ozone layer of the earth. Consequently, air conditioning and refrigeration systems must be changed. Furthermore, the use of individual compressors is energy-intensive and expensive. Present air conditioning and refrigeration systems are not environmentally friendly.

SUMMARY OF THE INVENTION

A new, uncomplicated, economical and simple air conditioning apparatus is disclosed for domestic and/or industrial use. The apparatus comprises a source of liquid nitrogen, a pressure vessel to receive liquid nitrogen from the source wherein the pressure vessel includes a release valve which controllably releases the liquid nitrogen to absorb latent heat and become nitrogen gas, a thermostat for controlling the release valve, a housing containing the pressure vessel, and a dehumidifying arrangement for dehumidifying warmer air from outside the housing to mix with the nitrogen gas within the housing to become a cooler air mixture. The dehumidifying arrangement further dehumidifies the cooler air mixture before directing the cooler air mixture outside the housing for air conditioning purposes.

The apparatus does not use a compressor and minimizes the use of moving parts. The apparatus simply utilizes liquid nitrogen as a refrigerant without a closed-coil, heat-exchanger system. Preferably, each unit is connected to a conduction network distribution system. The distribution system distributes liquid nitrogen wherein a jacket of liquid nitrogen is used to keep the conducted liquid nitrogen cold. Liquid oxygen can also be used for the same purpose. The air conditioning system disclosed herein can thus be used as an air conditioning system for a house, an industrial building, or even a small city.

DETAILED DESCRIPTION OF THE PREFERRED EMBODIMENT

Figure 1:
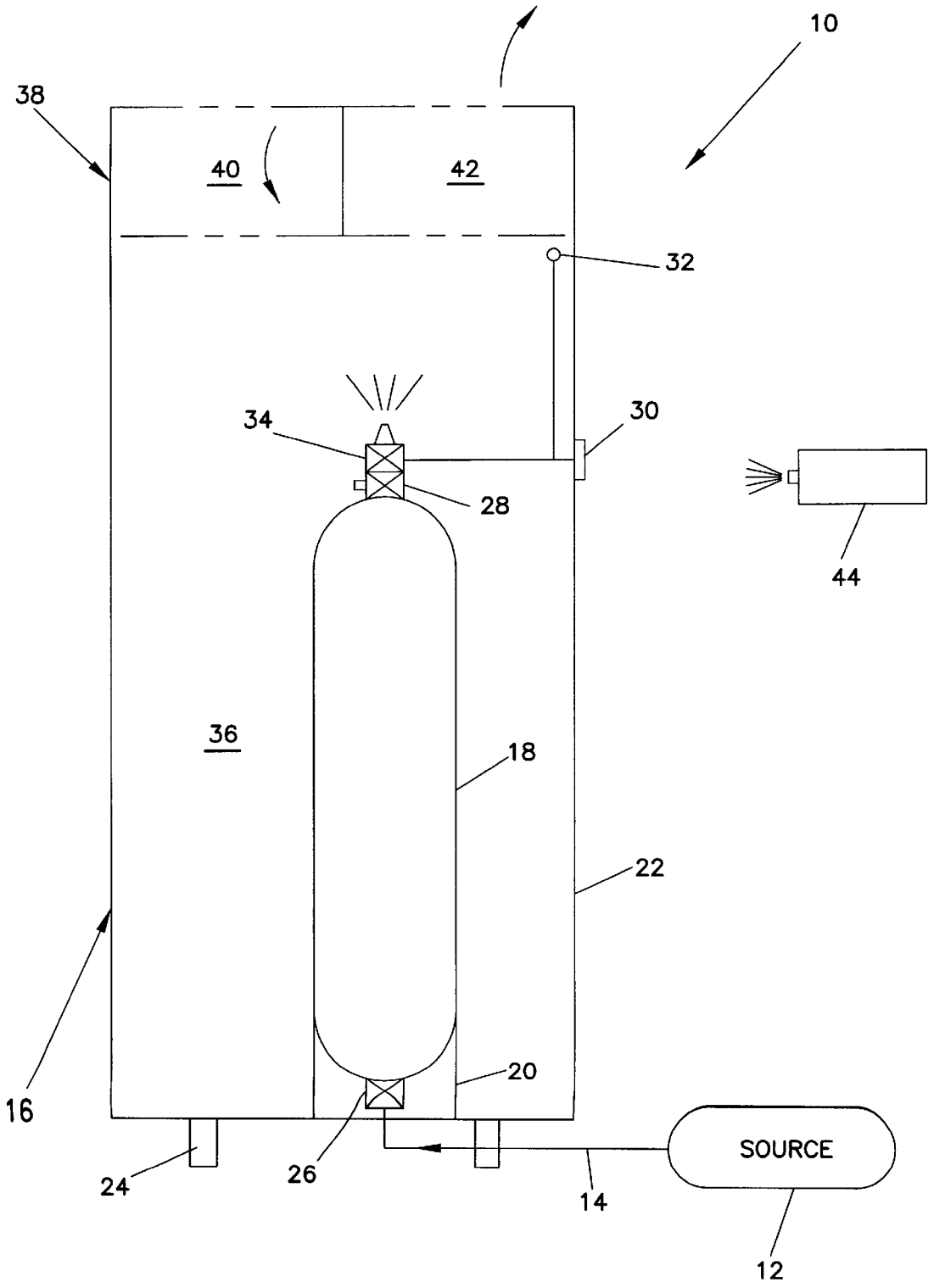
FIG. 1 is an illustration of apparatus in accordance with the present invention.
Figure 3:
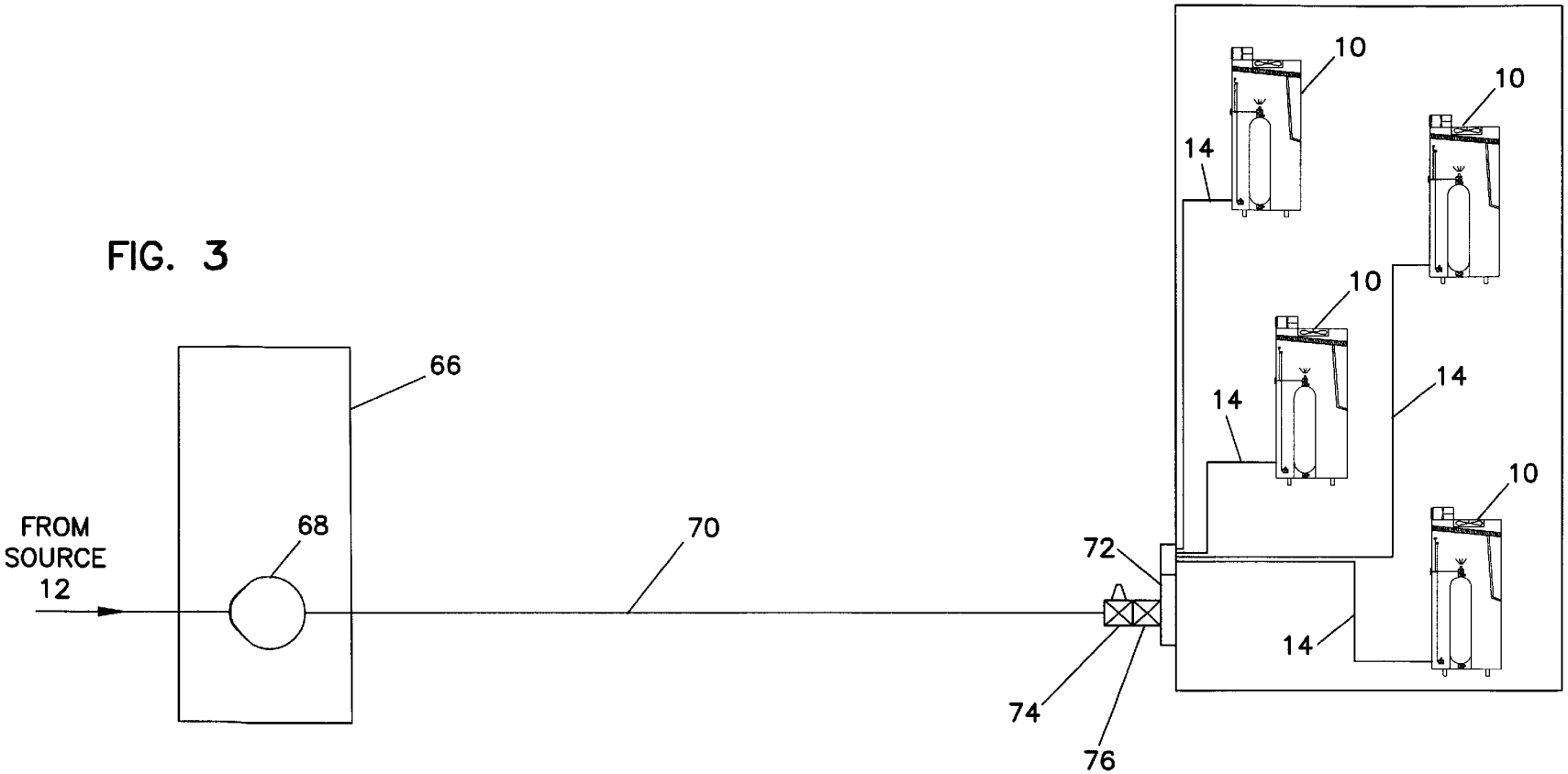
FIG. 3 is an illustration showing a plurality of the apparatus of FIGS. 1 or 2 as being supplied from the source.
Figure 4:
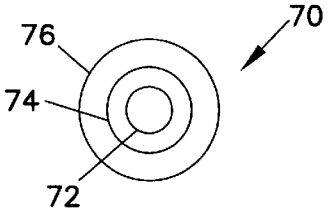
FIG. 4 is a cross-sectional view of a pipeline.
Figure 5:
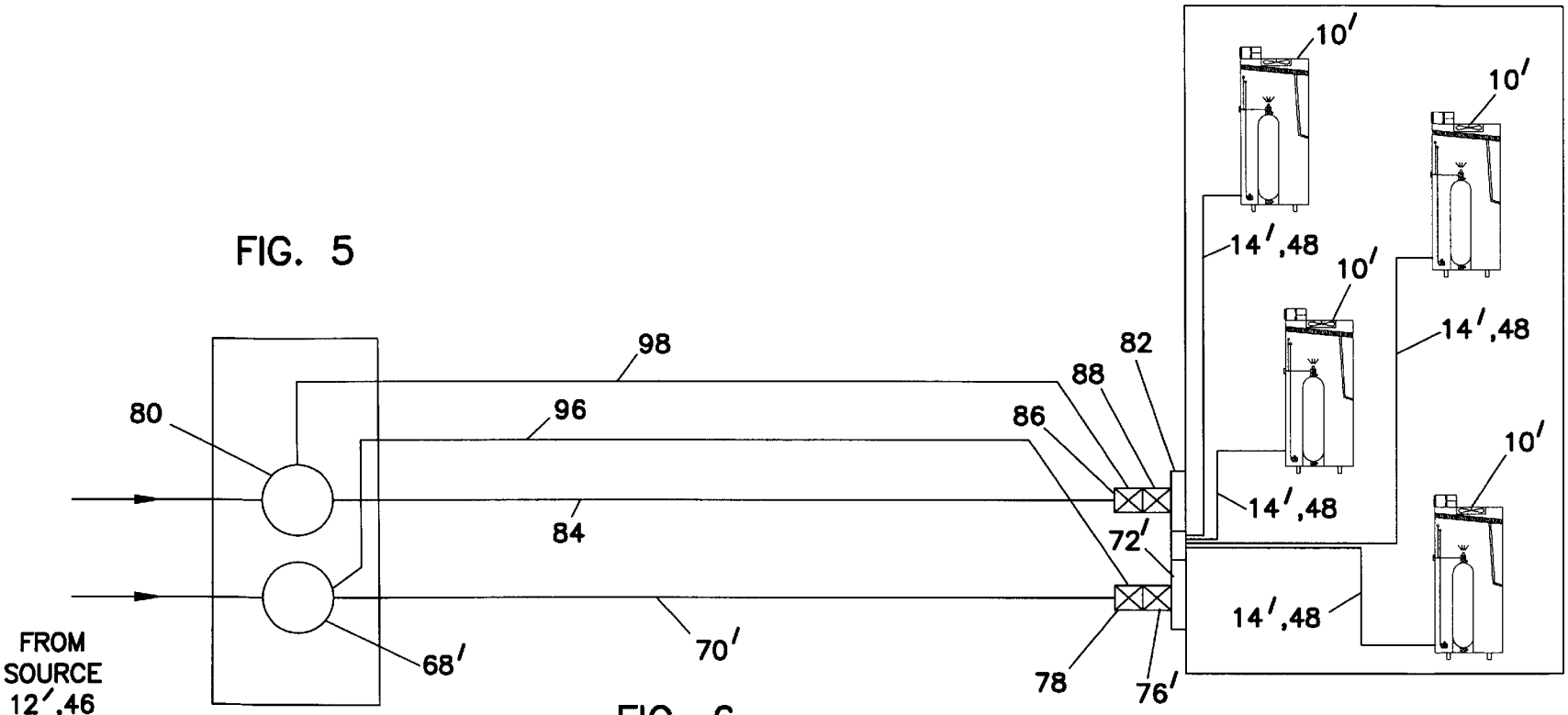
FIG. 5 is an alternative embodiment of the apparatus of FIG. 3.

Air conditioning apparatus in accordance with the invention is described with reference to the various figures wherein the same or similar elements are identified by the same numeral throughout the several drawings. With reference to FIG. 1, the air conditioning apparatus is designated generally by the numeral 10. Apparatus 10 includes a source of liquid nitrogen 12 which is delivered by pipeline 14 to unit 16. Air conditioning unit 16 is an assembly for usage in a house or other building. As shown in FIGS. 3 and 5, the source can supply a plurality of such units.

Unit 16 includes a pressure vessel 18 held by a support 20 within an enclosed housing 22. Housing 22 can have legs 24 to rest on the floor of a room. Line 14 is connected to pressure vessel 18 via a solenoid control valve 26. Valve 26 opens to allow liquid nitrogen to flow into pressure vessel 18. A flow meter, pressure transducer, float switch, or other device (not shown) for monitoring the amount of liquid nitrogen in pressure vessel 18 functions as a sensor to provide the necessary information to determine when the liquid nitrogen in pressure vessel 18 should be replenished. When replenishment is needed, valve 26 is appropriately opened. When sufficient liquid has filled pressure vessel 18, valve 26 is closed. Preferably, pressure vessel 18 includes an insulation jacket. Care must be exercised to insulate the pressure vessel from condensation and the formation of ice.

A regulator or relief valve 28 prevents pressure in pressure vessel 18 from exceeding a safe limit. A thermostat 30 having a sensor 32 controls valve 34 relative to controllably releasing nitrogen into the space 36 enclosed by housing 22. That is, the thermostat is set for a particular temperature and the sensor within space 36 senses the temperature. When the temperature rises excessively, valve 34 is opened to allow nitrogen to be released. As the liquid nitrogen vaporizes, it absorbs substantial latent heat in the warmer air, thereby creating a new cooler air mixture. A dehumidifying arrangement 38 includes mechanism for dehumidifying and blowing warmer air from outside housing 22 into space 36 to mix with nitrogen gas and become the cooler air mixture. It is important to dehumidify the warmer air which is make-up air for the system. The moisture in the warmer air otherwise would condense and freeze on cold surfaces as it mixed within space 36. Dehumidifying arrangement 38 also includes mechanism 42 for drawing the cooler air mixture so as to be further dehumidified before flowing outside of housing 22 from space 36 to thereby direct the cooler air mixture into a surrounding room for air conditioning purposes. The cooler air mixture is further dehumidified before passing through mechanism drawing the air mixture. As indicated, it is important to keep the humidity level low and condensation to a minimum.

A remote control unit 44 can be used to control thermostat 30. It is noted that the various valves and pressure vessel are conventional. Similarly, dehumidifying units 40 and 42 can simply be conventional dehumidifier units commonly used on furnaces or as stand-alone units. Thermostat 30 and remote unit 44 are also conventional.

In use, valve 26 is opened so that pressure vessel 18 can be filled with liquid nitrogen from source 12. Thermostat 30 is set for a desired temperature. Sensor 32 senses the temperature within space 36 at a location near where the cooler air mixture from space 36 is drawn from space 36 to the atmosphere outside of housing 22. When the temperature sensed is higher than the thermostatically desired temperature, valve 34 is opened to allow liquid nitrogen to gassify and mix with warmer air blown through dehumidifier unit 40. The warmer air mixes with the gassified nitrogen to create a cooler air mixture which is then drawn through dehumidifier unit 42.

If pressure within pressure vessel 18 becomes too great, relief valve 28 opens to relieve and regulate the pressure.

Apparatus 10 is particularly advantageous since nitrogen is a very large component in the composition of air and its cooling capacity is simply being used to cool warmer air. A central source of liquid nitrogen is used to resupply a small local reservoir. A thermostat senses temperature and controls release of nitrogen from the local reservoir. The entire system is very simple and minimizes moving parts. The apparatus is environmentally friendly and inexpensive. It is not energy intensive.

Figure 2:
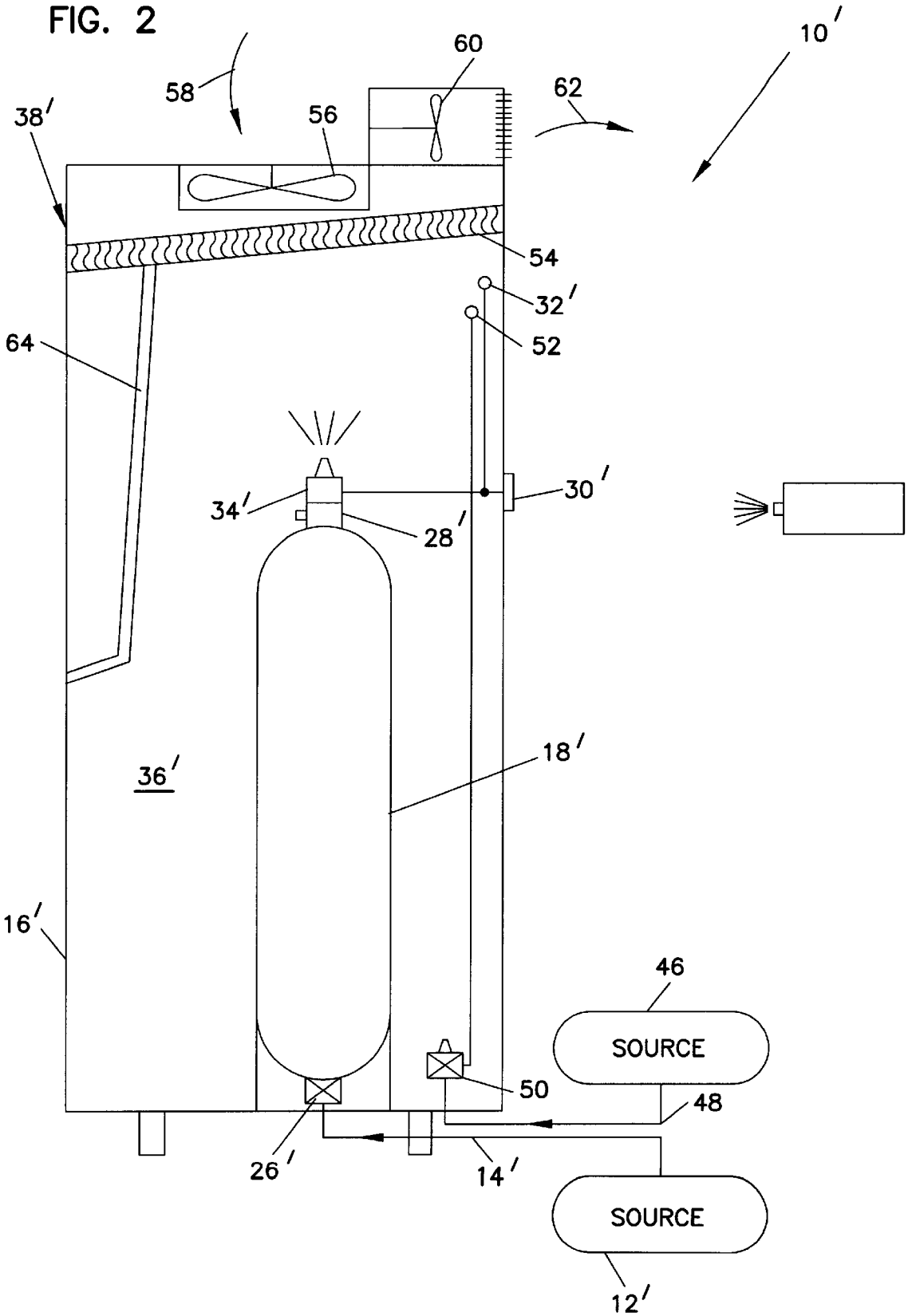
FIG. 2 is an illustration of an alternate embodiment of apparatus in accordance with the present invention.

Apparatus 10' shown in FIG. 2 is an alternate embodiment. Source 12' is connected via line 14' and valve 26' to pressure vessel 18' for the purpose of delivering liquid nitrogen to pressure vessel 18'. Source 46 is a source of oxygen. Source 46 and source 12' may be the same process wherein both liquid nitrogen and liquid oxygen are created. Liquid oxygen is delivered via a pipeline 48 to an ejection valve 50 located within space 36'. A gas analyzer 52 analyzes the composition of the cooler air mixture to determine whether it is oxygen-deficient. If so, ejection valve 50 is solenoid-operated and is controlled to release liquid oxygen and allow it to gassify into space 36' to further mix with the cooler air mixture and replenish oxygen thereto.

As with apparatus 10, apparatus 10' includes relief valve 28' and ejection valve 34' as controlled by thermostat 30 having sensor 32. Device 10' is contained within housing 16'.

Dehumidifier arrangement 38' is an alternative and includes a dehumidifying panel 54 which is conventional. An input fan 56 blows air in a direction 58 from outside housing 16' through panel 54 into space 36'. Warmer air from outside is mixed with gassified nitrogen to become a cooler air mixture. The cooler air mixture is drawn through panel 54 by output fan 60 and blown in direction 62 into the building heating/cooling distribution system or simply into the atmosphere outside of housing 16'. Water condensed by panel 54 is directed via line 64 out of housing 16'.

Dehumidifying arrangement 38' functions to remove the humidity from the warmer air and prevent ice from forming on input and output fans 56, 60. Thus, apparatus 10' can function indefinitely without freezing the fans.

Apparatus 10' having the feature of controlling the oxygen content in the cooler air mixture composition is particularly applicable for hospitals and other environments where the oxygen content is important.

In FIG. 3, there is shown a pumping station 66 having pump 68 for moving liquid nitrogen from source 12 through line 70 to a manifold 72 via relief valve 74 and control valve 76. Pump 68 and valves 74 and 76 are conventional. Manifold 72 is known to those skilled in the art.

Relief valve 74 regulates pressure particularly within concentric passage 73, although there may also be a relief valve (not shown) in communication with central passage 71. Control valve 76 is solenoid operated and allows liquid nitrogen to be pumped into manifold 72 and through various lines 14 to various apparatuses 10 as required.

Preferably, line 70 has a central passage 71 for containing the liquid nitrogen to be used in the various apparatuses 10. A concentric passage 73 also preferably contains liquid nitrogen. The liquid nitrogen in concentric passage 73 is used to maintain the liquid nitrogen in central passage 71 at a desired cold temperature. Any gassification or buildup of pressure within concentric passage 73 is relieved at relief valve 74. Further concentric wrapping of insulation 75 helps to maintain the desired cool temperatures.

Each of lines 14 preferably have a similar construction as line 70.

An alternative distribution system is shown in FIG. 5. Both liquid nitrogen and liquid oxygen are directed from respective sources 12', 46. Liquid nitrogen is directed through vapor-driven pump 68' to manifold 72' via line 70' and valves 78 and 76'. Similarly, liquid oxygen is directed from source 46 through vapor-driven pump 80 to manifold 82 via line 84 and valves 86 and 88.

Figure 6:
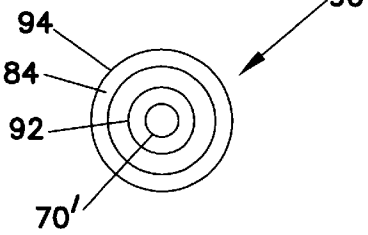
FIG. 6 is a cross-sectional view of an alternate embodiment of a pipeline.

Preferably, lines 70' and 84 are constructed in a unified structure shown in FIG. 6 as line 90. Line 90 has a central passage 71' for liquid nitrogen. A concentric passage 92 for ajacket of liquid nitrogen surrounds central passage 71'. Concentric passage 93 containing liquid oxygen surrounds concentric passage 92. Liquid oxygen has a liquefying temperature of −249° F., which is significantly warmer than liquid nitrogen. A further concentric wrapping of insulation 94 helps to prevent heat from reaching the interior passages.

As liquid nitrogen in jacket 92 and liquid oxygen in jacket 93 warm and gassify, pressure is relieved through valves 78 and 86, respectively. The gassified nitrogen is directed through line 96 to help drive vapor-driven pump 68'. Similarly, vaporized oxygen is directed through line 98 to help drive vapor-driven pump 80. In this way, the system efficiency is kept high by using the pressure of the gassified nitrogen and oxygen to drive the pumps which deliver the liquid nitrogen and liquid oxygen.

As liquid nitrogen and liquid oxygen are used by the various apparatuses 10', liquid nitrogen is distributed at manifold 72' when control valve 76' opens. Similarly, liquid oxygen is delivered from manifold 82 when control valve 88 opens. Control valves 76' and 88 open as liquid nitrogen and liquid oxygen are used. It is understood that there may be a relief valve (not shown) on passage 70', and that lines 14' may be constructed like line 90.

Thus, a central source of liquid nitrogen and liquid oxygen are used in order to deliver the liquid nitrogen and liquid oxygen via vapor-driven pumps to appropriate manifolds and therefrom to appropriate air conditioning apparatuses. The system is simple and economical. Alternatives are indicated. It is understood, however, that further alternatives are possible and that the invention is limited only by the equivalents of the claims.

What is claimed:

1. Air conditioning apparatus, comprising:

a source of liquid nitrogen;

a pressure vessel to receive the liquid nitrogen from said source, said pressure vessel including a release valve which controllably releases the liquid nitrogen to absorb latent heat and become nitrogen gas;

a thermostat for controlling said release valve;

a housing containing said pressure vessel; and a dehumidifying arrangement for dehumidifying warmer air from outside said housing to mix with said nitrogen gas within said housing to become a cooler air mixture, said dehumidifying arrangement for further dehumidifying the cooler air mixture before directing the cooler air mixture outside said housing.

2. The apparatus in accordance with claim 1, wherein said dehumidifying arrangement includes a dehumidifying panel and an input fan for blowing the warmer air through the dehumidifying panel.

3. The apparatus in accordance with claim 1, wherein said dehumidifying arrangement includes a dehumidifying panel and an output fan for drawing the cooler air mixture through the dehumidifying panel.

4. The apparatus in accordance with claim 1, including means for analyzing volumetric composition of the cooler air mixture and means for releasing oxygen to mix with the cooler air mixture.

5. The apparatus in accordance with claim 1, further including a pressurized line and a pump between said source and said pressure vessel, said line having a central passage for said liquid nitrogen, a first concentric passage for a cooling jacket of liquid nitrogen, and a second concentric passage for liquid oxygen, said apparatus further including means for directing gassified nitrogen and oxygen from said first and second concentric passages to said pump to help drive said pump.

6. Air conditioning apparatus, comprising:

a source of liquid nitrogen and a source of liquid oxygen;

a plurality of units including:

a pressure vessel to receive the liquid nitrogen from said source of liquid nitrogen, said pressure vessel including a release valve which controllably releases the liquid nitrogen to absorb latent heat and become nitrogen gas;

a thermostat for controlling said release valve;

a housing containing said pressure vessel;

a dehumidifying arrangement including a dehumidifying panel and an input fan for blowing warmer air from outside said housing through the dehumidifying panel to mix with the nitrogen gas inside said housing to become a cooler air mixture, said dehumidifying arrangement further including an output fan for drawing the cooler air mixture through the dehumidifying panel to direct the cooler air mixture outside said housing;

a pipeline and a pump between said sources of liquid nitrogen and liquid oxygen and said plurality of units, said line having a central passage for the liquid nitrogen, a first concentric passage for a cooling jacket of liquid nitrogen, and a second concentric passage for liquid oxygen, said apparatus further including means for directing gassified nitrogen and oxygen from said first and second concentric passages to said pump to help drive said pump; and means for analyzing volumetric composition of the cooler air mixture and means for releasing oxygen to mix with the cooler air mixture in said housing.

* * * * *